US007033465B1

(12) United States Patent
Patton et al.

(10) Patent No.: US 7,033,465 B1
(45) Date of Patent: Apr. 25, 2006

(54) CLAMSHELL APPARATUS WITH CRYSTAL SHIELDING AND IN-SITU RINSE-DRY

(75) Inventors: Evan E. Patton, Portland, OR (US); Jonathan D. Reid, Sherwood, OR (US); Jeffrey A. Hawkins, Portland, OR (US); Dinesh S. Kalakkad, Portland, OR (US)

(73) Assignee: Novellus Systems, Inc., San Jose, CA (US)

( * ) Notice: Subject to any disclaimer, the term of this patent is extended or adjusted under 35 U.S.C. 154(b) by 544 days.

(21) Appl. No.: 10/309,414

(22) Filed: Dec. 2, 2002

Related U.S. Application Data

(60) Provisional application No. 60/335,238, filed on Nov. 30, 2001.

(51) Int. Cl.
*C25D 17/00* (2006.01)

(52) U.S. Cl. ..... 204/227; 204/212; 204/242; 204/275.1

(58) Field of Classification Search ..... 204/212, 204/227, 242, 275.1
See application file for complete search history.

(56) References Cited

U.S. PATENT DOCUMENTS

| | | | | |
|---|---|---|---|---|
| 5,221,449 | A | 6/1993 | Colgan et al. | 204/192.15 |
| 5,281,485 | A | 1/1994 | Colgan et al. | 428/457 |
| 5,482,611 | A | 1/1996 | Helmer et al. | 204/298.17 |
| 5,985,762 | A | 11/1999 | Geffken et al. | 438/687 |
| 6,074,544 | A | 6/2000 | Reid et al. | 205/157 |
| 6,099,702 | A | 8/2000 | Reid et al. | 204/212 |
| 6,110,346 | A | 8/2000 | Reid et al. | 205/157 |
| 6,124,203 | A | 9/2000 | Joo et al. | 438/653 |
| 6,126,798 | A | 10/2000 | Reid et al. | 204/282 |
| 6,139,712 | A | 10/2000 | Patton et al. | 205/143 |
| 6,156,167 | A | 12/2000 | Patton et al. | 204/270 |
| 6,159,354 | A | 12/2000 | Contolini et al. | 205/96 |
| 6,162,344 | A | 12/2000 | Reid et al. | 205/157 |
| 6,176,985 | B1 | 1/2001 | Downes, Jr. et al. | 204/297.1 |
| 6,179,973 | B1 | 1/2001 | Lai et al. | 204/192.12 |
| 6,179,983 | B1 | 1/2001 | Reid et al. | 205/96 |
| 6,193,854 | B1 | 2/2001 | Lai et al. | 204/192.12 |

(Continued)

FOREIGN PATENT DOCUMENTS

WO WO 99/41434 8/1999

OTHER PUBLICATIONS

Shin-Etsu Polymer Co., Ltd., "L-Type Connector," http://www.shinpoly.co.jp/business/connector/products_e/l.html?typezeb (1 page), no date.

(Continued)

*Primary Examiner*—Arun S. Phasge
(74) *Attorney, Agent, or Firm*—Beyer Weaver & Thomas, LLP

(57) ABSTRACT

Certain mechanisms of a plating apparatus address problems associated with interaction between plating solutions or other processing solutions and the components of the plating apparatus (such as the electrical contacts). For example, a circumferential spray skirt around the interface of a "cup" and "cone" in the plating apparatus protects these features during plating. A shield mechanism contacts the cup and/or cone at the periphery of their interface to provide a fluid resistant seal. In some cases, the cone includes an outer circumferential lip that engages a complementary surface of the cup for this purpose. Further, a mechanism is provided for raising and lowering the work piece with the cone in order to allow in situ rinsing of the work piece and/or regions of the cup.

31 Claims, 9 Drawing Sheets

U.S. PATENT DOCUMENTS 6,217,716 B1 4/2001 Fai Lai ..... 204/192.12
6,221,757 B1 4/2001 Schmidbauer et al. ..... 438/625
6,251,238 B1 6/2001 Kaufman et al. ..... 204/242
6,251,242 B1 6/2001 Fu et al. ..... 204/298.19
6,261,433 B1 7/2001 Landau ..... 205/96
6,270,646 B1 8/2001 Walton et al. ..... 205/93
6,274,008 B1 8/2001 Gopalraja et al. ..... 204/192.17
6,277,249 B1 8/2001 Gopalraja et al. ..... 204/192.12
6,551,487 B1 * 4/2003 Reid et al. ..... 205/137
6,755,946 B1 * 6/2004 Patton et al. ..... 204/224 R
6,800,187 B1 * 10/2004 Reid et al. ..... 205/118

OTHER PUBLICATIONS

Shin-Etsu Polymer Co., Ltd., "SS-Type Connector," http://www.shinpoly.co.jp/business/connector/products_e/ss.html?typezeb (2 pages), no date.

* cited by examiner

CLAMSHELL APPARATUS WITH CRYSTAL SHIELDING AND IN-SITU RINSE-DRY

CROSS REFERENCE TO RELATED APPLICATIONS

This application claims priority under 35 U.S.C. §119(e) from U.S. Provisional Patent application No. 60/335,238, filed Nov. 30, 2001 by Patton et al. The entire contents of that provisional patent application are incorporated herein by reference for all purposes.

BACKGROUND

The present invention pertains to features and methods that protect components of a clamshell apparatus during electroplating, electropolishing, electroless plating or other wet deposition process.

U.S. patent application Ser. No. 10/010,954, filed Nov. 30, 2001, by Patton et al. (incorporated herein by reference) describes an exemplary "clamshell" apparatus for electrochemically treating semiconductor wafers. As described there, a "cup" and "cone" of a clamshell apparatus can take many forms. In one embodiment, the cup of has a ring structure with a flat top surface (including an inner circumferential edge or "lip" as shown in FIGS. 1F–I of U.S. patent application Ser. No. 10/010,954). Generally, the cup and cone assembly holds, positions, and rotates a wafer during, for example, electroplating, electroless plating, electropolishing, or other wet chemical deposition or removal process. A lipseal on the lip of the cup may contain embedded contacts for delivering plating current to a seed layer on a wafer. The clamshell provides backside protection to the wafer. In other words, electrolyte is prevented from contacting the edge and backside wafer when immersed during a plating process. Backside protection is afforded by fluid-resistant seals that are formed when the cup and cone engage one another to hold a wafer (refer to U.S. patent application Ser. No. 10/010,954 for more description).

Plating solution is generally comprised of a solution of metal ions in acidic or basic aqueous media. For example, an electrolyte may be composed of copper sulfate dissolved in dilute sulfuric acid. During processing, plating solution is often splashed into parts not wetted during immersion; for example the cone, rotation components, seals, vacuum sealing components, and the like. Solution in these areas evaporates, causing copper sulfate to precipitate out of solution and crystallize. These crystals cause particle contamination, metallic contamination, and mechanical reliability problems when they deposit on mating surfaces.

In a somewhat related issue, electrical contacts, which deliver plating or polishing current to the wafer, can become contaminated and their performance degraded after thousands of cycles. Also, reverse pulse plating has been found to lead to copper build-up on the lip seal. Further, reversible failure can occur even when the plating system sits idle. It is therefore desirable to have rinsing and drying capability of the contact and lip seal area to prevent contamination build-up, thereby improving tool and process reliability.

Sealed contacts necessarily have a high profile step at the edge of the lip seal which creates a "pocket" where liquid remains even when rotated at high rotational speeds. Furthermore, the step creates a stagnant zone, trapping rinsate and preventing thorough rinsing of the wafer surface.

To address these problems arising from plating solution contacting sensitive clamshell components, improved designs are required.

SUMMARY

This invention addresses problems arising from interaction between plating solutions (or other processing solutions) and the components of the clamshell apparatus (such as the electrical contacts described above). It addresses these problems by providing a circumferential spray skirt around the cone and/or the interface of the cup and the cone. It also provides a shield mechanism that contacts the cup and/or cone at the periphery of their interface to provide a fluid resistant seal. In some cases, the cone includes an outer circumferential lip that engages a complementary surface of the cup to provide the seal. Further, the apparatus may provide a mechanism for raising and lowering the work piece with the cone in order to allow in situ rinsing of the work piece and/or regions of the cup.

One aspect of this invention provides an apparatus for engaging a work piece during a plating process. Such apparatus may be characterized by the following features: (a) a cup having an interior region and a lip within the interior region arranged such that the lip can support the work piece while the work piece remains within the interior region; (b) a cone having a work piece contact surface that fits within the cup's interior and can contact the work piece in a manner that holds the work piece in a fixed position between the work piece contact surface and the lip; and (c) a spray skirt extending about an outer circumference of the cone and an interface between the cup and the cone when cup and cone engage each other to hold the work piece. The spray skirt protects features on the plating apparatus from exposure to a plating solution during plating.

The spray skirt may be affixed to the apparatus in many different ways. In one example, it is attached to the cone. But in alternative embodiments, it is attached to the cup or to some other element of the apparatus. Frequently, the spray skirt will be a vertical cylindrical structure. In some embodiments, it may include flat circular plate engaging a top region of the cylindrical structure. Preferably, the spray skirt is made of a material that is resistant to corrosive plating solutions and is electrically insulating. Examples include plastics and other organic-based polymeric materials such as PVDF, PPS, PTFE, polypropylene, PVC, and polyethylene. While conductive, stainless steel may also be used in some applications.

The spray skirt may be provided with a cup-contacting surface that blocks penetration of the plating solution to the interface between the cup and the cone during plating. In an alternative embodiment, the cone includes a circumferential shielding lip extending about its lower surface and engaging a complementary surface on the cup to thereby block penetration of the plating solution to the interface between the cup and the cone during plating. In some embodiments, the complementary surface of the cup includes an elastomeric seal.

In a preferred application of the present invention, the work piece is a semiconductor wafer. It may be plated with a copper seed layer and/or a bulk copper fill using the apparatus of this invention. These features may be plated by electroless plating and/or electroplating for example, one example of an electroplating solution is an acidic solution of copper ions.

While not central to the present invention, the cup's lip can include a lip seal made from a material that provides a fluid-tight seal with the semiconductor wafer when the wafer is held in place by the cone. In a specific example, the width of the lip seal is between about 0.25 and 4 mm wide (preferably between about 0.25 and 1 mm wide). It is made from an elastomer such as a silicone rubber, a fluoropolymer, or a butyl rubber. Regarding the cup generally, it is preferably made from at least one of a plastic, a ceramic, a plastic-coated ceramic (e.g. a fluoropolymer coated alumina or zirconia), a plastic-coated metal, a glass, a glass-coated metal, a glass-coated ceramic, a silicon-oxide coated ceramic, and a composite.

Another aspect of this invention pertains to an apparatus for engaging a work piece that allows cleaning of the apparatus while it holds the work piece. This apparatus may be characterized by the following features: (a) a cup as described above; (b) a cone as described above; (c) a mechanism for temporarily attaching the work piece to the cone's work piece contact surface, whereby the work piece, together with the cone, can be separated from the cup; and (d) a cleaning fluid delivery device for delivering a cleaning fluid while the work piece is attached to the cone's work piece contact surface. The cleaning fluid is delivered to clean the cup, the cone, and/or the work piece. In one embodiment, the cleaning fluid delivery device includes a spray nozzle, which may be disposed in a plating chamber that houses the cup and cone.

The mechanism for temporarily attaching the work piece to the cone's work piece contact surface is a vacuum engagement device, for example. It may include remote control value or a poppet valve in the cone. The poppet valve activates when the cone contacts the work piece.

These and other features and advantages of the invention will be described in more detail below with reference to the associated drawings.

DETAILED DESCRIPTION OF A PREFERRED EMBODIMENT

The following description assumes that the work piece to be plated is a wafer, more particularly a semiconductor wafer. The invention is not so limited. The work piece may be of various shapes, sizes, and materials. In addition to semiconductor wafers, other work pieces that may take advantage of this invention include various conductive articles such as machine tools, weaponry, recording heads, recording media, and the like. Further, while the invention is described below in terms of an electroplating apparatus and method, it is not limited in this way. The apparatus and methods of the invention can be used for electroplating, electropolishing, electroless plating or other wet deposition process.

Reduction in crystal build-up or corrosion on sensitive plating apparatus components is achieved using a crystal shield which keeps the plating solution and mist away from the clamshell vacuum sealing area. Thus a "crystal shield" is an apparatus that provides protection from crystal build up resulting from electrolyte or other processing fluids accumulating on a wafer holder and associated apparatus. Contact rinsing/drying is achieved by incorporating in-situ rinse-dry capability into a plating apparatus. An exemplary clamshell apparatus having a crystal shield and rinse/dry capability is depicted in FIGS. 1A–1D.

Figure 1A:
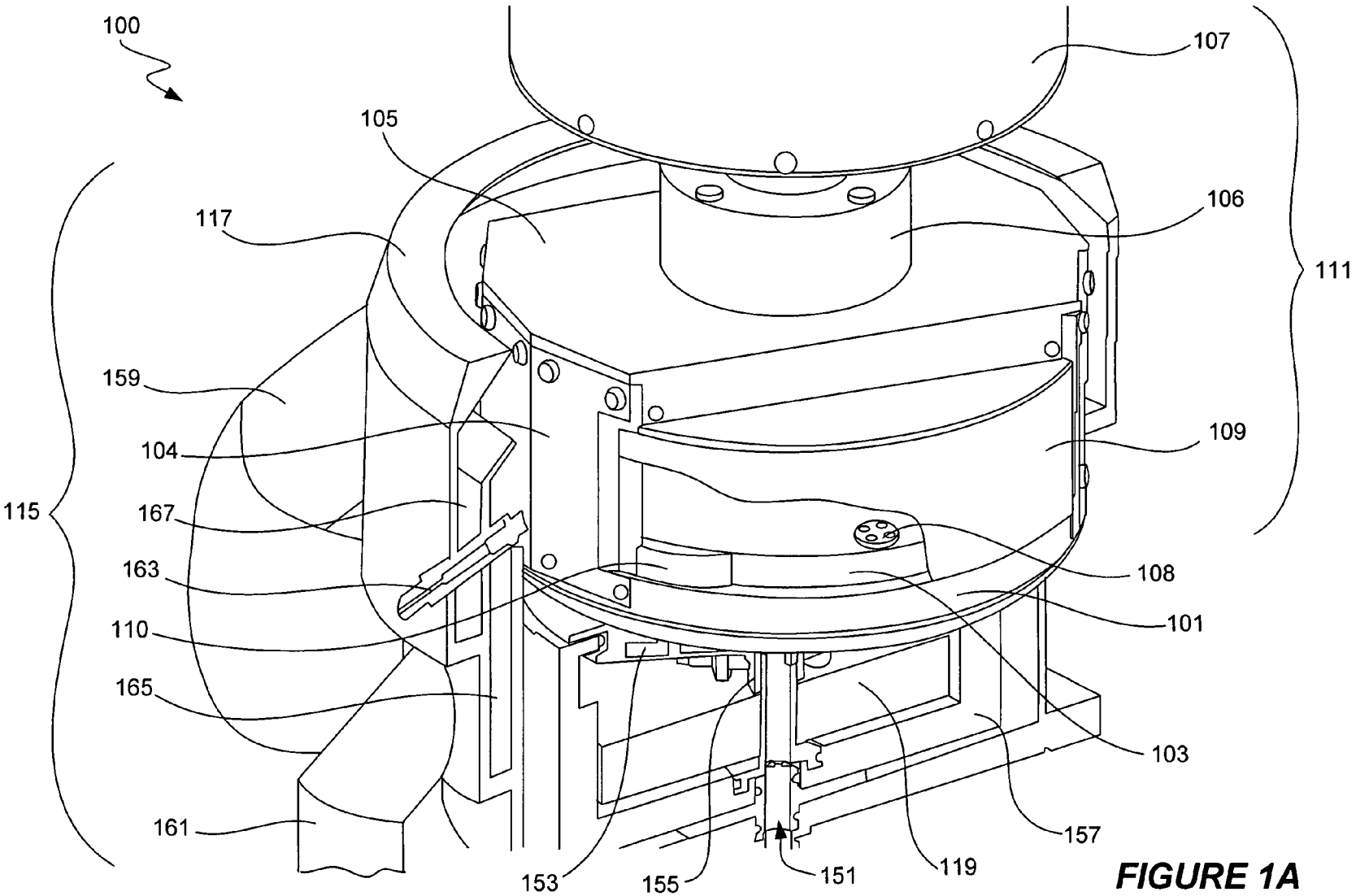
FIG. 1A is a perspective view of a wafer holder assembly for electrochemically treating semiconductor wafers used in accordance with an embodiment of this invention.

FIG. 1A provides a perspective view of a wafer holding and positioning apparatus 100 for electrochemically treating semiconductor wafers. Some features are seen more clearly in FIGS. 1B, 1C, and/or ID, where identical features are referenced by the same numbers.

Apparatus 100 includes wafer-engaging components (sometimes referred to herein as "clamshell" components) that are pertinent to embodiments of the invention. The actual clamshell assembly comprises a cup 101 and a cone 103. As will be shown in subsequent figures, cup 101 holds a wafer and cone 103 clamps the wafer securely in the cup. Various cup and cone designs beyond those specifically depicted here can function in accordance with this invention. Importantly, the cup has an interior region in which the work-piece sits and the cone presses the work-piece against a region of the cup to hold it in place.

In the depicted embodiment, the clamshell assembly (cup 101 and cone 103) is supported by struts 104, which are connected to a top plate 105. This assembly (101–105) is driven by a motor 107, via a spindle 106 connected to top plate 105. Motor 107 is attached to a mounting bracket (not shown). Spindle 106 transmits torque (via motor 107) to the clamshell assembly to create rotation of a wafer (not shown in this figure) held therein during plating. An air cylinder (not shown) within spindle 106 also provides vertical force for engaging cup 101 with cone 103. When disengaged, an end effector can insert a wafer in between the cup and cone. After a wafer is inserted, the cone is engaged with the cup that immobilizes the wafer within apparatus 100. Once immobilized in apparatus 100, only the wafer front side (work surface) is exposed.

In accordance with this invention, a poppet valve 108 on cone 103 actuates when the cone comes in intimate contact with the cup. At that point, the top of the cup is exposed to a vacuum to hold it against the cone. Under these conditions, the work piece is tightly held between the cup and the cone.

In addition, the invention provides a spray skirt 109 that protects the cone from splashing electrolyte. In the depicted embodiment, spray skirt 109 includes a vertical circumferential sleeve and a circular cap portion. It has an associated fluid resistant sealing mechanism 110' that protects the lipseal and contacts from electrolyte during plating. Mechanism 110' includes a "cup-contacting surface" that engages the cup during plating to provide a fluid resistant seal. This aspect of mechanism 110' is seen most clearly in FIG. 1D. A similarly oriented spacing member 110 is shown in FIG.

1A. Spacing member 110 maintains separation between spray skirt 109 and cone 103.

For the purposes of this discussion, the assembly including components 101–110 is collectively referred to as a "wafer holder" 111. Note however, that the concept of a "wafer holder" extends generally to various combinations and subcombinations of components that engage a wafer and allow its movement and positioning.

A tilting assembly (not shown) may be connected to the wafer holder to permit angled immersion (as opposed to flat horizontal immersion) of the wafer into a plating solution. A drive mechanism and arrangement of plates and pivot joints is used in some embodiments to move wafer holder 111 along an arced path (not shown) and thus tilt the proximal end of wafer holder 111 (i.e. cup and cone assembly).

Further, the entire wafer holder 111 is lifted vertically either up or down to immerse the proximal end of wafer holder into a plating solution via an actuator (not shown). Thus, a two-component positioning mechanism provides both vertical movement along a trajectory perpendicular to an electrolyte and a tilting movement allowing deviation from a horizontal orientation (parallel to electrolyte surface) for the wafer (angled-wafer immersion capability). A more detailed description of the movement capabilities and associated hardware of apparatus 100 is described in U.S. patent application Ser. No. 09/872,341, filed May 31, 2001 by Reid et al. and incorporated by reference herein for all purposes.

Note that wafer holder 111 is used with a plating cell 115 having a plating chamber 117 which houses an anode chamber 157 and plating solution. Chamber 157 holds an anode 119 (e.g., a copper anode) and may also include membranes or other separators designed to maintain different electrolyte chemistries in the anode compartment and a cathode compartment. In the depicted embodiment, a diffuser membrane 153 is employed for directing electrolyte upward toward the rotating wafer in a uniform front. This embodiment is described in U.S. patent application Ser. No. 09/927,740, filed Aug. 10, 2001 by S. Mayer et al. ("Methods and Apparatus for Controlling Electrolyte Flow for Uniform Plating"), which is incorporated herein by reference for all purposes. The plating cell may also include a separate membrane for controlling electrolyte flow patterns. In another embodiment, a membrane is employed to define an anode chamber, which contains electrolyte that is substantially free of suppressors, accelerators, or other organic plating additives. This embodiment is described in more detail in U.S. patent application Ser. No. 09/706,272, filed Nov. 3, 2000, naming S. Mayer et al. as inventors, and incorporated herein by reference for all purposes.

The plating cell may also include plumbing or plumbing contacts for circulating electrolyte through the plating cell—and against the work piece being plated. For example, cell 115 includes an electrolyte inlet tube 151 that extends vertically into the center of anode chamber 157 through a hole in the center of anode 119. In some cases, the inlet tube 151 includes outlet nozzles on both sides (the anode side and the cathode side) of membrane 153. This arrangement delivers electrolyte to both the anode chamber and the cathode chamber. As shown in the embodiment of FIG. 1A, an inlet nozzle 155 provides electrolyte to the anode-side of membrane 153.

In addition, plating cell 115 includes rinse drain line 159 and a plating solution return line 161, each connected directly to plating chamber 117. Also a rinse nozzle 163 delivers deionized rinse water to clean the wafer and/or cup during normal operation. Plating solution normally fills much of chamber 117. To mitigate splashing and generation of bubbles, chamber 117 includes an inner weir 165 for plating solution return and an outer weir 167 for rinse water return. In the depicted embodiment, these weirs are circumferential vertical slots in the wall of plating chamber 117.

Figure 1B:
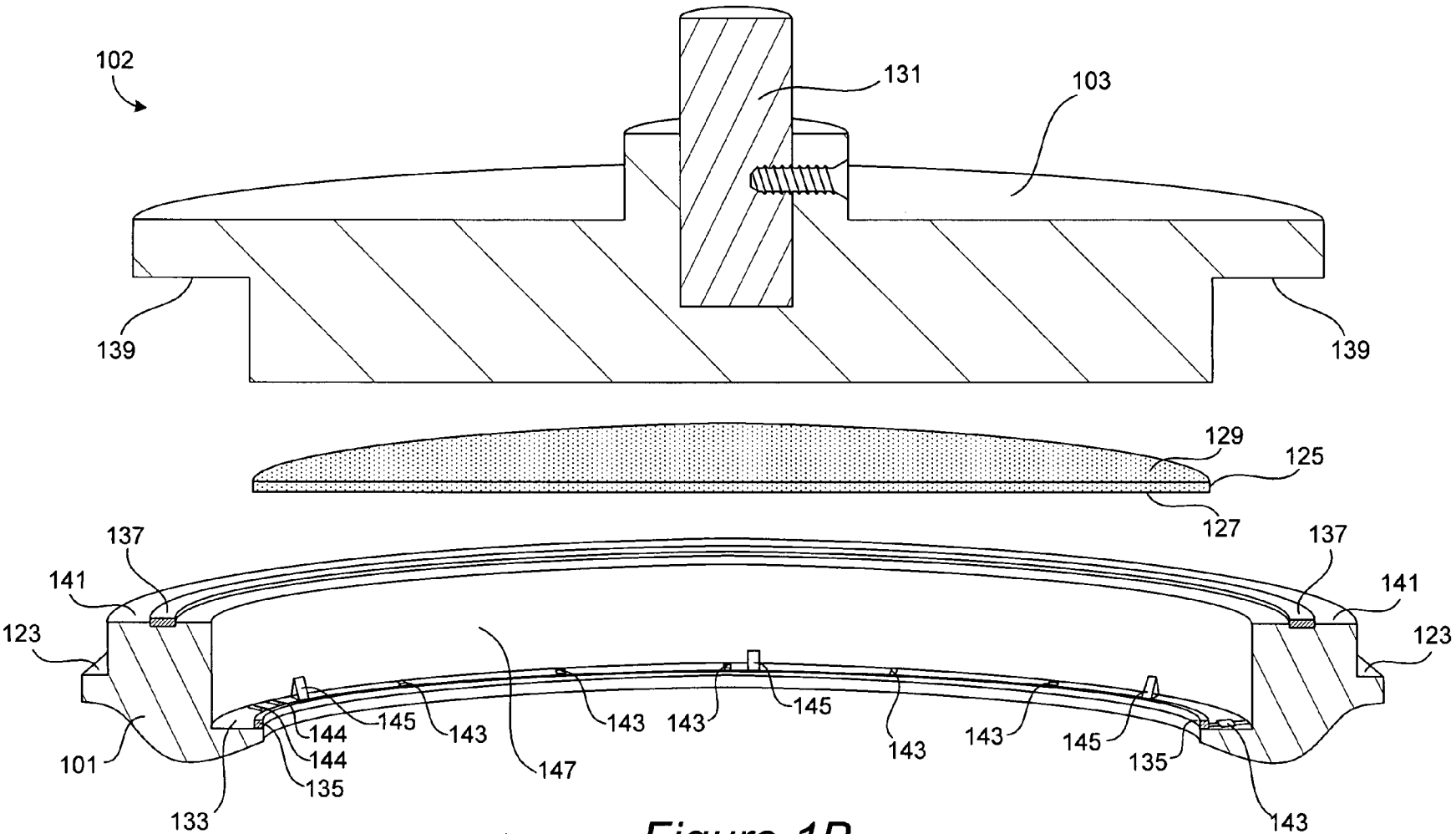
FIG. 1B is a cut away perspective diagram depicting aspects of a cup and cone assembly (emphasizing a lip of the cup) as used in an electroplating apparatus in accordance with the embodiment of FIG. 1A.

The following description presents additional features of cup and cone clamshell assemblies that may be employed with the invention. For consistency, reference numbers from FIG. 1A will be used in subsequent figures, where appropriate. FIG. 1B is a cross sectional depiction of a portion 102 of assembly 100, including cup 101 and cone 103. Note that this figure is not meant to be an absolutely accurate depiction of the cup and cone assembly, but rather a simplified illustration for depicting certain features of the cup's lip. It does not show a spray skirt or struts for example.

As shown, cup 101 is covered by top plate 105. While not shown in FIG. 1B, struts 104 connect the top plate to the cup (refer to FIG. 1A, struts 104 are secured to cup 101 in the area of outer edge 123 (depicted in FIG. 1B)). Cone 103 moves vertically within the assembly including the cup, struts, and top plate via an air cylinder (not shown). Generally, cup 101 provides a support upon which wafer 125 rests. It includes an opening through which electrolyte from a plating cell can contact the wafer. Note that wafer 125 has a front side 127, which is where plating occurs. Only the periphery of wafer 125 rests on the cup. When engaged with cup 101, cone 103 presses down on the backside of the wafer, 129, to hold it in place during plating.

To load a wafer into assembly 102, cone 103 is held in a raised position, as depicted, via the air cylinder (until cone 103 touches top plate 105). From this position, a gap is created between the cup and the cone into which wafer 125 can be inserted, and thus loaded into the cup. Note in FIG. 1A that struts 104 are positioned on opposing sides of cup 101, covering only part of its circumference, thus the wafer is inserted between the opposing struts. Once the wafer is resting on cup 101, cone 103 is lowered to engage the wafer against the periphery of cup 101. Note also that wafer plating typically occurs while the wafer is rotating. As electrolyte flows upward towards the wafer, the rotation provides nearly uniform mass transfer to the wafer over the entire radial extent of the wafer.

Cup 101 supports wafer 125 via a lip 133. More specifically, the lip has a compressible lip seal 135, which forms a fluid-tight seal when cone 103 engages wafer 125 against lip seal 135. The lip seal prevents electrolyte from contacting the backside of wafer 125 (where it could introduce contaminating atoms such copper directly into silicon) and from contacting sensitive components of apparatus 101. Also shown is seal 137, which is also compressed (between ledge 139 of the cone and surface 141 of the cup) to form a fluid tight seal when cone 103 engages wafer 125. Thus, once the cup and cone are engaged, the wafer backside is protected from electrolyte exposure. Again, this figure is a simplified depiction.

As mentioned, before initiation of plating, wafer 125 is introduced to assembly 102 when cone 103 is raised above cup 101. When the wafer is initially introduced—typically by a robot end effector—its outermost edge rests lightly on lip seal 135. Wafer 125 must electrically communicate with a current source to maintain a potential difference between the anode and cathode (the wafer itself). In this invention, lip seal 135 has embedded contacts (not depicted in FIG. 1B) that are connected to a plurality of electrical contacts, which are divided into two groups. One group of electrical contacts, 143, is part of a first circuit for providing plating current to the work piece, and the other group of electrical contacts, 144, is part of a second circuit for measuring resistance of a metal layer deposited on the wafer. Preferably (but not necessarily) the second circuit is used to measure the resistance of a seed layer before plating commences and during a plating process.

Also shown in FIG. 1B, a plurality of wafer guides 145 are provided on lip 133 of cup 101. These guides are used to orient wafer 125 such that its outermost edge aligns accurately with lip seal 135. Note that cup 101 includes a circumferential sidewall 147 which defines an interior region of the cup and a lip 133 for supporting wafer 125. The invention is not limited to cups of this shape or configuration. A "cup" of the invention can include a structure not having such a circumferential sidewall. For example, an alternate cup design has a ring structure with a flat top surface (including an inner circumferential edge or "lip"). In this case, such a flat surface having similar wafer guides 145 may define a "cup" in the context of this invention.

Preferably at least a portion of the cup is made from a material including at least one of a plastic, a ceramic, a plastic-coated ceramic, a glass-coated ceramic, a plastic-coated metal, a glass, a glass-coated metal, and a composite. A preferred plastic used in the coating of the plastic-coated ceramic or metal is PPS (Polyphenylene Sulfide), PVDF (Polyvinylidene Fluoride) or a fluoropolymer. Preferred materials for a ceramic or a ceramic used in the plastic-coated ceramic are alumina or zirconia. Lip seal 135 is preferably made of an electrolyte resistant elastomer with poor bath wetting characteristics. Examples of suitable elastomers include Chemraz (Green, Tweed, and Co.), Sifel (Shin-Etsu Polymer Co., Ltd.), Viton (Dupont), Tefzel (Dupont), Kalrez (Dupont-Dow), and various silicone rubbers. Generally, fluoropolymers work well for this seal material. In a particularly preferred embodiment, cup 101 is made of a ceramic. There are commercially available elastomers with embedded conductors suitable for the lip seal of the invention. Such commercially available elastomers with embedded conductors may include, for example, ShinEstu connectors (Shin-Etsu Polymer Co., Ltd.).

When engaged with cup 101, the cone (not shown) applies a downward force on wafer 125 and pushes it against lip seal 135. The cone also presses directly against seal 137. Once the cone compresses these two seals, the backside of wafer 125 is protected from plating solution. Also protected are electrical contacts 143 and 144. Additional protection may be provided to electrical contacts 143 and 144 by a glass coating (not shown).

Wafer guides 145 are shaped and positioned in such a way as to guide the wafer accurately to a resting point on lip seal 135. As the wafer is lowered into cup 101, the outer edge slides along guides 145 until the wafer is aligned on lip seal 135. Once in place, lip seal 135 touches the outer most edge of the seed layer (not shown) on the wafer. Upon compression against wafer 125, lip seal 135 will deform only slightly. Preferably, when the cone is engaged with the wafer and cup 101, the width of lip seal 135 will be between about 0.25 and 1 mm, preferably about 0.25 mm. By moving the lip seal out to the edge of the wafer, and by using a thin lip seal, the usable area of the plated wafer is increased. In some preferred embodiments, only an edge bevel of wafer 125 lies over the edge of lip seal 135 closest to wafer guide 145, when the cup and cone are engaged.

In a preferred embodiment, electrical connection may be maintained by contact through electrical contacts 143 and shaft 131. In this example, shaft 131 is electrically connected (e.g. via wiring within shaft 131) to a current source, which feeds electrical contacts 143. Electrical current can be passed to the seed layer of the wafer when the wafer is resting on the lip seal whether or not the cone is engaged with the cup.

The poppet valve 108 depicted in FIGS. 1A and IC allows the cone and cup to engage by a vacuum. As shown in FIG. 1D, the cone 103 includes a pair of vacuum seals 150 that engages cup 101 when the cup and cone connect with each other to hold a work piece in place. A vacuum source (not shown) provides the force needed to temporarily affix the cup to the cone. FIGS. 2B–2E depict this feature in an alternate embodiment. FIG. 1D also depicts a fastener 152 that affixes spray skirt 109 to cone 103. Further, it depicts certain electrical features including a set of contacts 156 and an electrically connected a bus bar 158. The bus bar can be provided in various designs (e.g., 1, 2, or 4 pieces) and can be made from various conductive materials such as tantalum.

A few other features are worth mentioning. An o-ring 154 in cone 103, as depicted in FIG. 1D, provides a surface against which the wafer backside rests when coupled to the cone. Also, the spray nozzle 163 of the plating cell 115 can provide a stream of water or other cleaning fluid. Preferably, this is performed while the work piece is removed from the wafer holder. A sequence of operations associated with an in situ rinse procedure is presented in detail below with reference to FIGS. 2A–2E and the associated discussion of the alternate embodiment. The rinse operations could apply equally, however, to all embodiments of this invention. Generally, an in situ rinsing mechanism obviates the need for a separate spin/rinse/dry apparatus.

The spray skirt 109 shown in FIGS. 1A, IC, and ID is but one of many examples of spray skirts suitable for use with this invention. Generally, the spray skirt protects features on the cup from exposure to a plating solution during plating. Typically, it will extend about an interface between the cup and the cone when the cup and cone engage one another to hold the work piece. Thus, it may also extend about the actual cup and/or the cone. It will generally follow the contours of the interface's circumference. In many cases, the cup and/or cone has a circular perimeter, so the spray skirt will also be circular or cylindrical, although the invention is not limited to this configuration. In the embodiments depicted in the figures, the spray skirt includes a vertical cylindrical structure. Often, it will also include a flat circular plate engaging a top region of the cylindrical structure, as depicted in FIG. 1A.

The spray skirt may be attached to the cup, the cone and/or some other structural feature of the clamshell apparatus. In the depicted embodiments, it is attached to the cone. It may be made from any material that resists degradation by the plating solution. Often the materials do not wet easily. Examples include plastics and other organic-based polymeric materials such as PVDF, PPS, PTFE, polypropylene, PVC, and polyethylene. Stainless steel and other corrosion resistant metals may be used in some embodiments.

A spray skirt protects the apparatus in various ways. For example, it functions to reduce air turbulence that is associated with dispersion of plating solution mist. This mist is a vector for the spread of copper (or other metal) contamination throughout the system and especially to a dry (and clean) robot end-effector. Thus, spray skirts reduce the frequency for preventative maintenance and thus improve system uptime/availability.

Figure 1C:
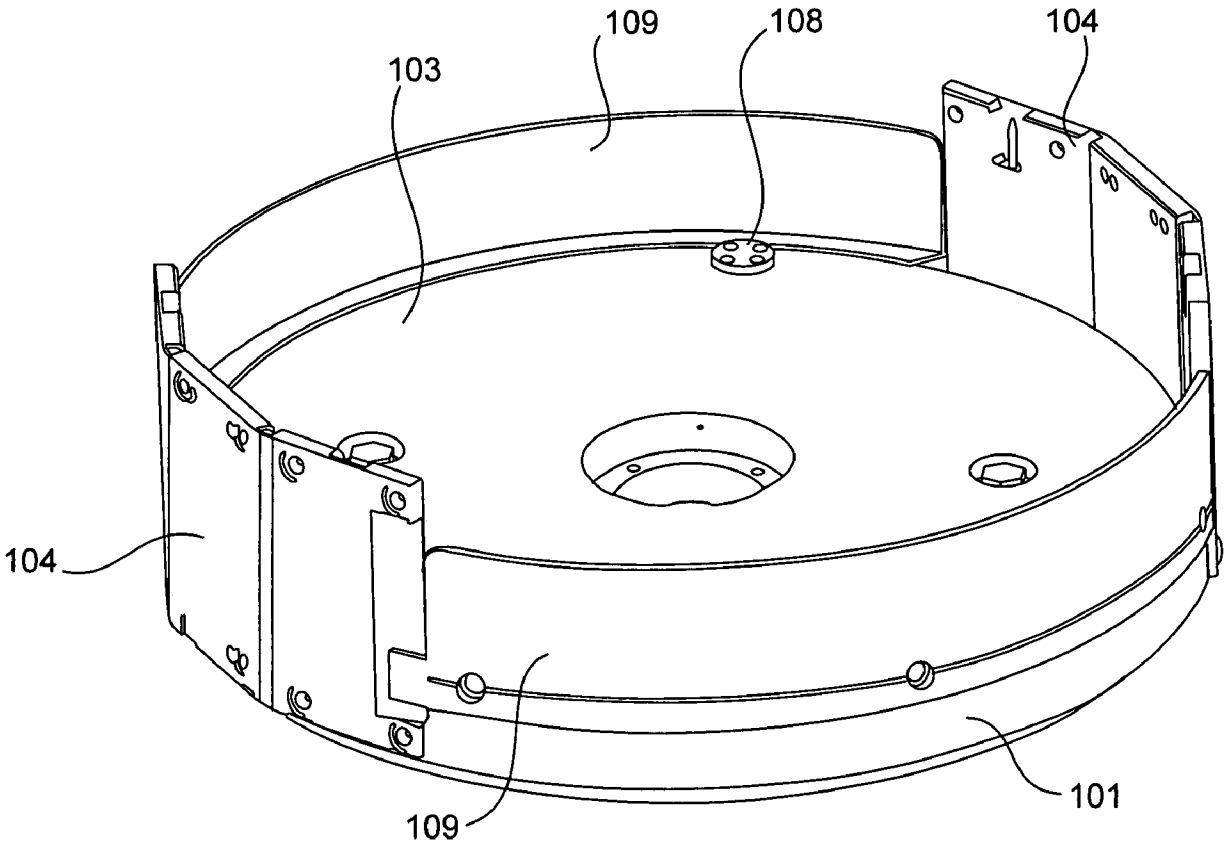
FIG. 1C is a perspective view of the cup, cone, and spray skirt of a wafer holder assembly related to that shown in FIG. 1A.
Figure 1D:
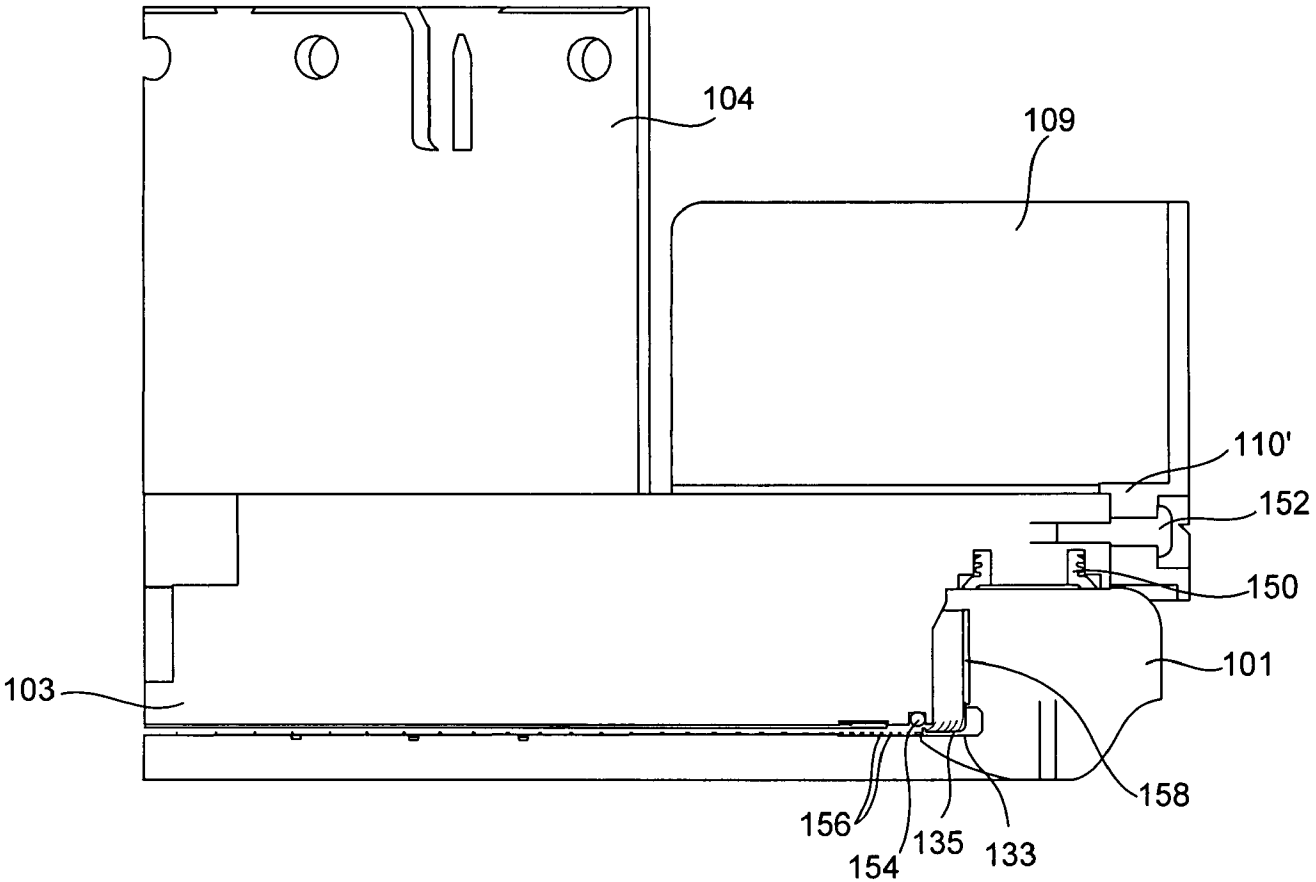
FIG. 1D is a cross sectional diagram depicting certain aspects of the features shown in FIG. 1C.

As shown in FIGS. 1A, 1C, and 1D, the plating apparatus also includes a sealing mechanism or "cup-contact surface" 110 or 110' attached to the spray skirt in order to block penetration of the plating solution to the interface between the cup and the cone during plating. In this manner, the cup-contact feature reduces the crystal build up observed in wet plating apparatus. To facilitate this role, the cup-contact surface can "self-clean" the seal between the cup and the cone. It does this by wiping off excess fluid and crystals from the cup surface when the cone and cup are brought into contact. Further, when in contact with the cup, the spray skirt sealing mechanism presents an obstacle at the "mouth" of the cup-cone interface. Thus, any fluid from the plating bath must take a tortuous route around the cup-contact surface and then in between the cup and cone in order to reach the cup's lip. This further reduces the likelihood of any fluid actually reaching the lip.

Note that plating solution is generally comprised of a solution of metal ions in acidic or basic aqueous media. For example, an electrolyte may be composed of copper sulfate dissolved in dilute sulfuric acid. During processing, plating solution is often splashed into parts not wetted during immersion, for example the cone, rotation components, seals, vacuum sealing components, and the like. Solution in these areas evaporates, causing copper sulfate to precipitate out of solution and crystallize. These crystals cause particle contamination, metallic contamination, and mechanical reliability problems when they deposit on mating surfaces. It is important to control the location and quantity of the crystal build-up as well as any contamination from electrolytic processing solutions.

Figure 2A:
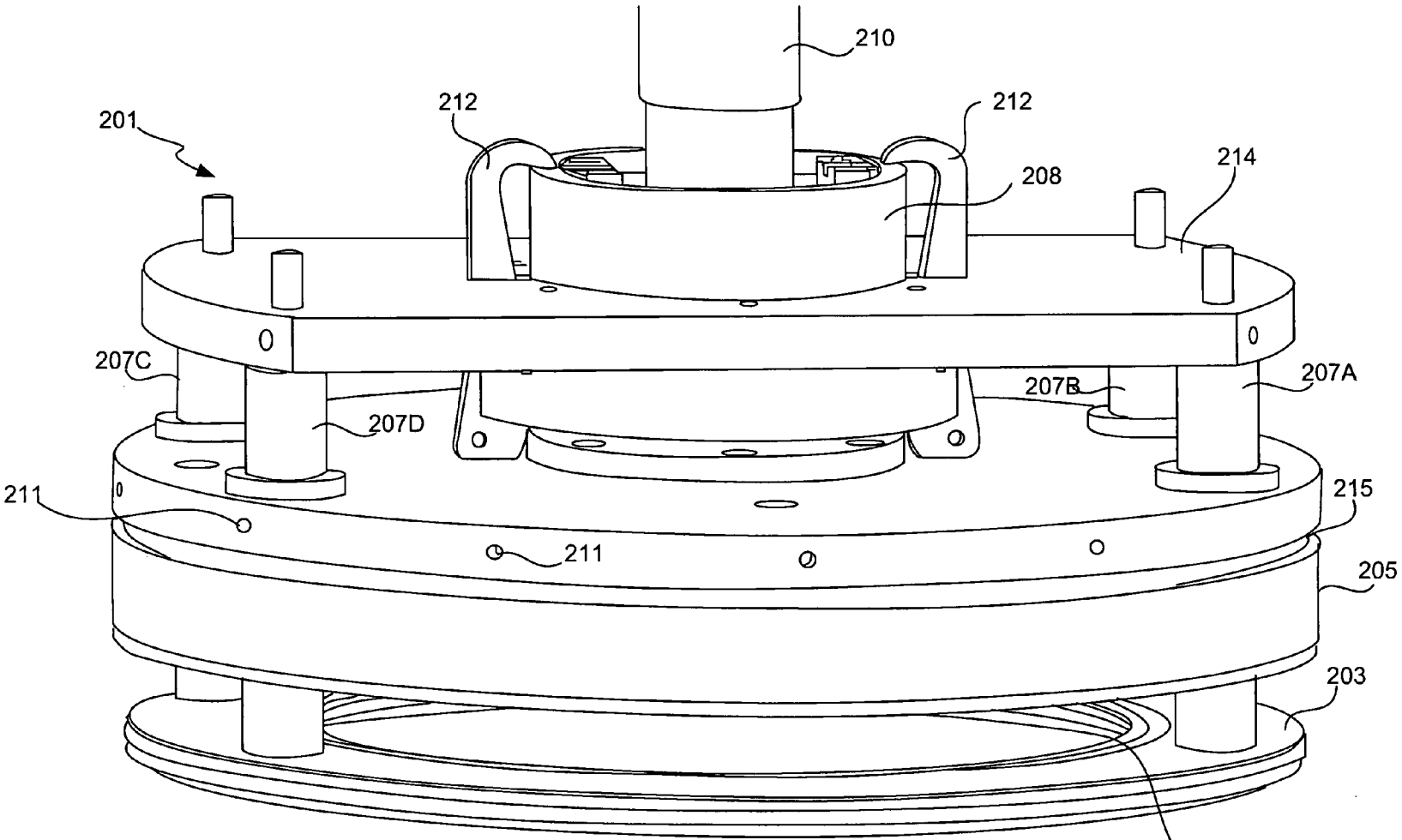
FIG. 2A is a perspective view of a wafer holder assembly in accordance with an alternate embodiment of this invention.
Figure 2B:
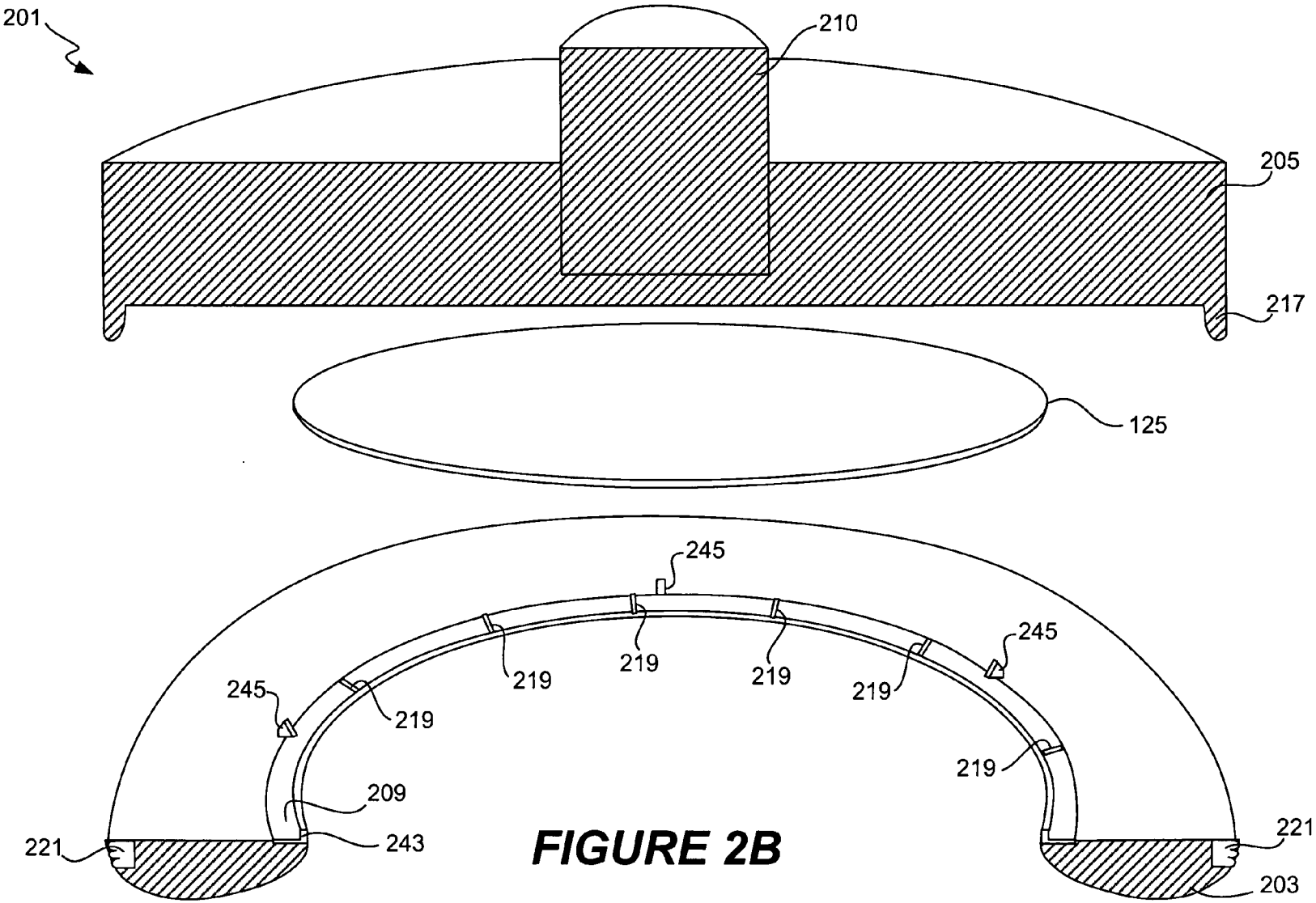
FIG. 2B is a cut away perspective diagram depicting aspects of a cup and cone assembly in accordance with the embodiment of FIG. 2A.
Figure 2C:
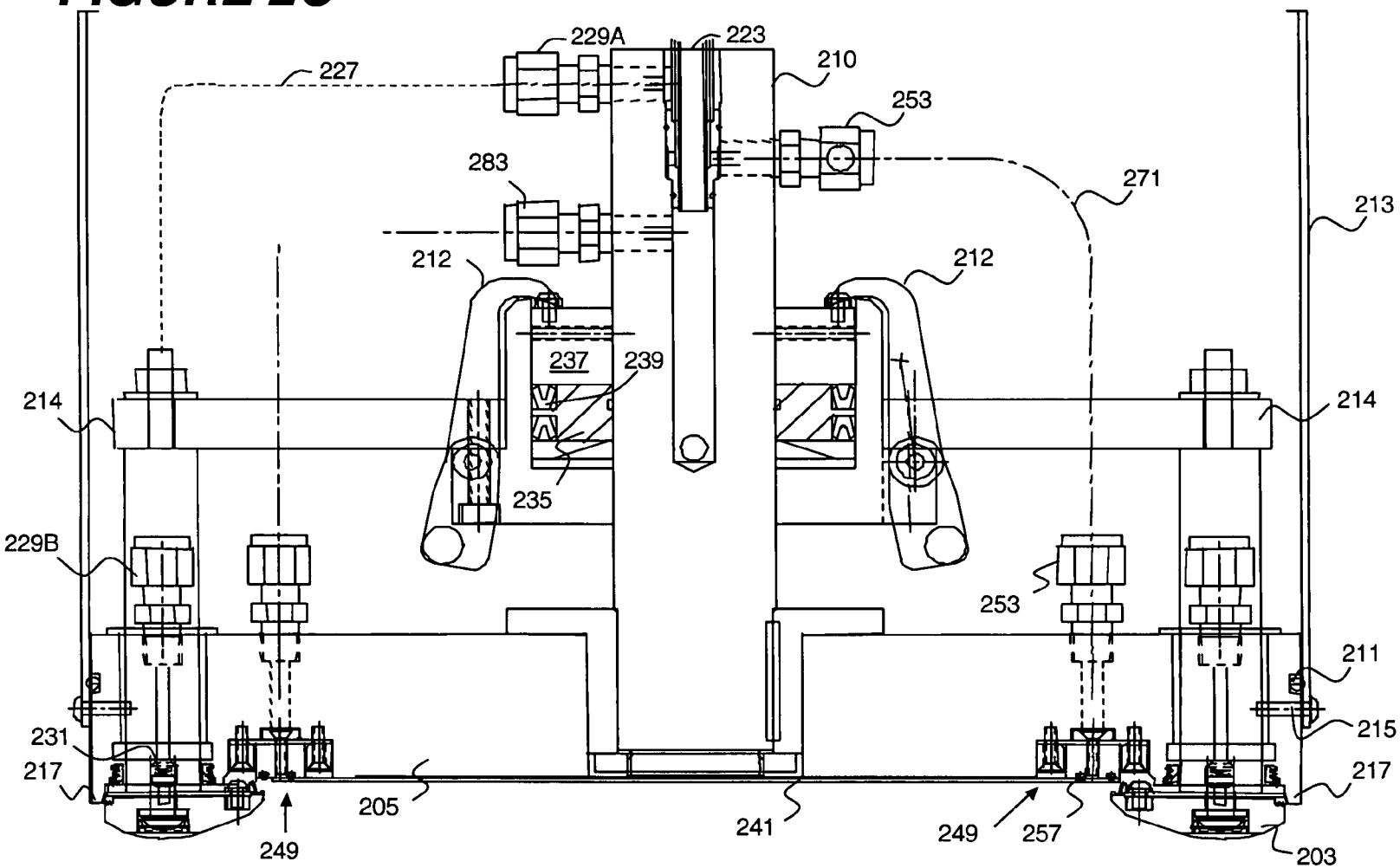
FIG. 2C is a full cross sectional diagram of the wafer holder assembly of the FIG. 2A embodiment.
Figure 2D:
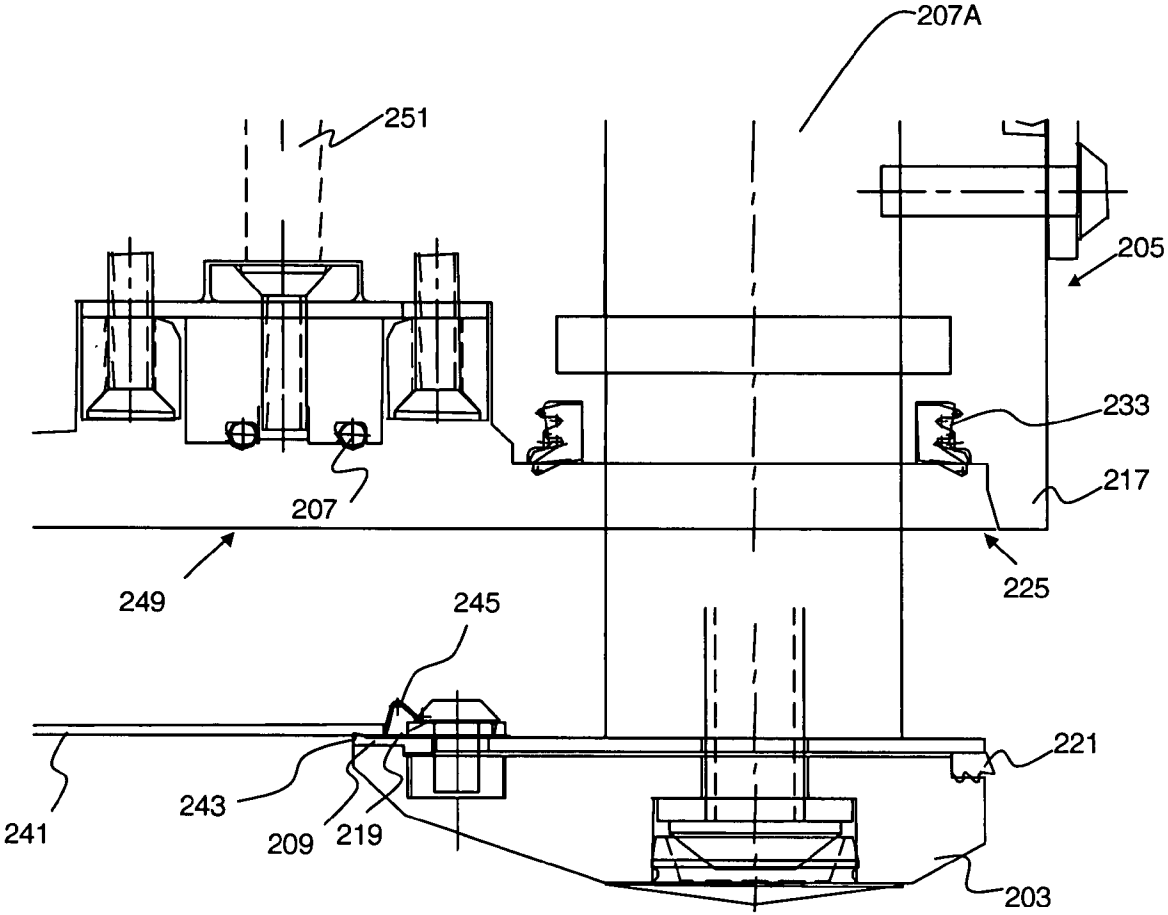
FIG. 2D is a partial cross sectional diagram showing features of the wafer holder assembly while in a position to accept a wafer.
Figure 2E:
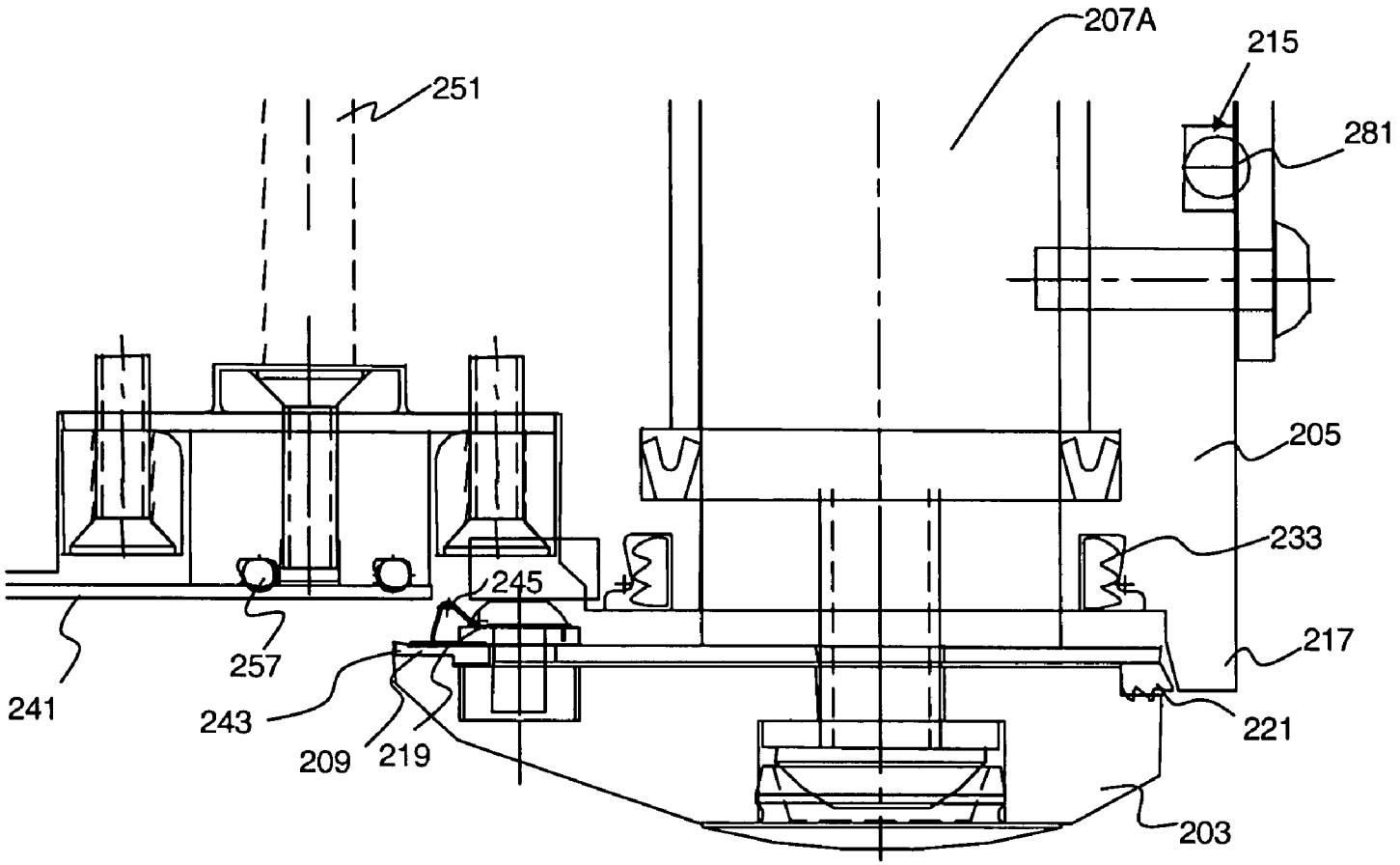
FIG. 2E is a partial cross sectional diagram as in FIG. 2D, but the cone has engaged a wafer and lifted it away from the cup to allow spray cleaning.

FIGS. 2A–2E depict a clamshell apparatus 201 in accordance with an alternative embodiment of the present invention. This embodiment employs a modified cup and cone design that shields portions of the apparatus from crystal build up. Crystal shielding is achieved by two separate shielding components. First is a spray skirt that is attached to the cone and covers the guide rods and closing mechanism (see FIG. 2C). Preferably the spray skirt is made of materials that are resistant to corrosive plating solutions and electrically insulating, as with the embodiment of FIGS. 1A–1D. Second is a sealing element, the "crystal shield" as depicted in FIGS. 2B–2E. In this example, the cone is configured to have a shielding lip. When the cone is engaged with the cup, the lip protrudes over the cup as depicted in FIGS. 2C and 2E. Combined with the lip of the cone is a seal on the cup which mates with the lip of the cone when the cone and cup are engaged.

Further, in this embodiment, the plating apparatus has a vacuum-clamping device for clamping the cone to the cup. The cone moves slidably along four shafts in order to engage and disengage with the cup. Also, the clamshell has a vacuum device for clamping the wafer to the cone. The wafer is held to the cone via a vacuum applied to the backside of the wafer via components within the cone.

As depicted, the alternate embodiment specifically includes cup 203 and cone 205 in a clamshell arrangement generally as described above. Cone 205 moves with respect to four guide rods 207A, 207B, 207C, and 207D to engage and disengage cup 203. The cup is moved by an actuator 208 comprising a cylinder operating in response to force provided by pressure or vacuum (e.g., a pneumatic cylinder). Actuator 208 is attached to a rotating drive shaft 210, which is attached to a top plate 214. More specifically, clamping members 212, as depicted, are cams that engage the cone at high rotational speeds (actuated via centrifugal force). This limits the upward motion of cone to secure the cup in an intermediate rinse position, and thereby improve rinsing of the contact area. The cams release when the rotational speed is reduced, then cone can open fully for wafer removal by robot.

Note that the cup 203 includes a lip seal 209 functioning as described above in the previous embodiment. Cone 205 has a series of holes 211 for engaging a spray skirt 213 depicted in FIG. 2C. The cone 205 also includes a grove 215 for an o-ring seal between 205 and 213. Note that the o-ring 281 is depicted in FIG. 2E.

Importantly, cone 205 also includes a circumferential lip shield 217 extending about its lower surface. It is designed to engage the outer circumferential region of cup 203, as depicted in FIGS. 2B and 2C, to thereby provide a fluid resistant seal that protects contacts 219 on the cup and prevents crystal build up from impairing mechanical reliability. The details of this sealing mechanism are presented most clearly in FIGS. 2B, 2D, and 2E. As shown there, lip shield portion 217 extends downward below the facing surface of cone 205. When the cup begins to engage the cone, lip 217 engages a seal 221 on the outer surface of the cone. This renders the outer interface of cup 203 and cone 205 fluid resistant.

Generally, the shielding lip circumferentially extends about the cone's lower surface and engages a complementary surface on the cup. This is intended to block penetration of the plating solution to the interface between the cup and the cone during plating. The shielding lip can be made from the same material as the cone (and be part of a monolithic structure) or it can be made from a separate material designed to provide an effective fluid tight seal. In some embodiments, the complementary surface of the cup includes an elastomeric seal. The seal (e.g. seal 221) is preferably made of an electrolyte resistant elastomer with poor bath wetting characteristics. Examples of suitable elastomers include Chemraz (Green, Tweed, and Co.), Sifel (Shin-Etsu Polymer Co., Ltd.), Viton (Dupont), Tefzel (Dupont), Kalrez (Dupont-Dow), and various silicone rubbers. Generally, fluoropolymers work well for this seal material.

When the cone tightly engages cup 203, a vacuum seal forms. In the depicted embodiment, this vacuum forms at the locations of the four guide rods. As illustrated in FIG. 2C, a vacuum is made available to the clamshell assembly 201 via a line 223 in shaft 210. The vacuum is connected to a vacuum engagement region 225 on the facing surface of cone 205 via a line 227 and including two swage lock fittings 229A and 229B. These vacuum lines extend through the guide rods 207A–D and terminate with poppet valves 231. In addition, vacuum engagement region 225 includes a pair of circular vacuum seals 233. When the cone 205 comes in intimate contact with cup 203, poppet valves 231 activate and allow vacuum seals 233 to engage the upper surface of cup 203.

Note that the actuator 208, responsible for vertical movement of cone 205, is depicted in detail in FIG. 2C. As shown there, a cylinder sleeve 237 slides along a piston 235 in response to changes in pneumatic force. Piston 235 is provided with sliding elastomeric seals 239, which serve as a piston ring.

Note also that FIGS. 2D and 2E depict the mechanism by which a wafer 241 (or other work piece) engages cup 203. As depicted, the elastomeric lip seal 209 includes a mating surface 243 for contacting wafer 241. Located just outward of surface 243 and on top of lip seal 209 is one of several contacts 219. As indicated above, these provide electrical contact to the wafer for purposes of electroplating and/or metrology. Still further, cup 203 includes wafer guides 245 serving the function described above.

The embodiment depicted in FIGS. 2A–2E allows the wafer 241 to be affixed to the cone as the cup is raised and lowered at appropriate times. In FIG. 2D, the wafer is lying on the lip seal region of cup 203. The cone has not yet engaged the wafer or cup. In FIG. 2E, however, wafer 241 is now attached to cone 205 and is, in fact, being held away from cup 203 to allow rinsing.

In the depicted embodiment, wafer 241 engages a facing lower surface of cone 205 by means of a second vacuum engagement region 249. In this embodiment, vacuum from line 271 is provided to region 249 via a line 251 through swage lock fittings 253. When cone 205 presses against wafer 241, vacuum can be applied directly to the wafer at the vacuum engaging regions 249. O-rings 257 are provided to facilitate this engagement. Alternatively, line 271 can be pressurized to ensure wafer 241 is pressed against seal 243 with sufficient force to ensure a leak-free seal.

As explained, electrical contacts which deliver plating or polishing current to the wafer, for example via an elastomer seal can become contaminated and their performance degraded after thousands of cycles or whenever the tool is idle—if the contacts are not rinsed after the last wafer processed. Also, reverse pulse plating has been found to lead to copper build-up on the lip seal. The in-situ rinsing and drying capability of this invention reduces contamination build-up in the lip seal area, thereby improving tool and process reliability.

It is desirable to separate the wafer from the contacts (and thus the elastomeric lip seal that contains the contacts) to perform rinsing and drying. Thus, the apparatus can be cleaned while still holding the work piece. By doing so within the clamshell apparatus, it is possible to perform thorough rinsing and drying in the plating apparatus, thus eliminating the need for a separate SRD (spin-rinse-dry module). Also, it is desirable to spray rinse with a chemical other than water to improve drying or to condition the plated metal surface (e.g. copper) after plating. The water and other chemicals can be delivered via a single nozzle (such as nozzle 163 of FIG. 1A) or through separate nozzles—delivering concurrent streams if necessary. Other cleaning fluid delivery devices for delivering a cleaning fluid while the work piece is separated from the cup are known to those skilled in the art. The cleaning fluid or other chemical may be sprayed directly onto the contacts. More generally, it may be sprayed onto the cup, the cone, and/or the work piece. As depicted in FIG. 1A, a spray nozzle may be disposed in a plating chamber that houses the cup and cone. Other locations (outside or inside the plating chamber) are suitable for use with this invention.

In one embodiment, the contacts (in the cup) are moved away from the cone and work piece by using a mechanism for temporarily attaching the work piece to the cone's work piece contact surface. In a specific embodiment, the mechanism for temporarily attaching the work piece to the cone's work piece contact surface is a vacuum engagement device, as depicted in FIGS. 2C–2E. It may include remote control values or a poppet valve in the cone that activates when the cone contacts the work piece. Other mechanisms from lifting the work piece off the cup (while still holding it in the clamshell apparatus) are known to those in the art. For example, a separate robotic mechanism may be employed for this purpose.

Note that in FIG. 2D, where the cup and cone are separated from one another, a robot end effector can bring the wafer into the plating apparatus between the cup and the cone. The end effector positions the wafer so that it rests on the cup. The cup and cone are then engaged, at which time the wafer clamp (elements 249, 251, and 257 shown in FIGS. 2C–E) are pressurized to hold the wafer against the cup. Also, a separate vacuum device as described above holds the cone and cup together. When the cup and cone are engaged and clamped together the wafer backside is protected and the components of the plating apparatus are protected from the electrolyte by the crystal shield and spray skirt.

There are three positions of wafer and cone that are relevant to in situ rinse processing. First, the wafer is loaded when the cone and cup are separated, in this example by 0.75 inches. FIG. 2D shows more detail of this wafer loading position. The end effector can fit between the cup and cone to deliver the wafer as mentioned above.

In the second position, the cup and cone are clamped together (closed) as described above. This is the position used during plating. In a third position, the cup is lowered so that there is a small separation between the wafer and the cup's lip seal. The wafer is held onto the cone by a employing a vacuum to elements 249, 251 and 257. As depicted in FIG. 2E, seals (an o-ring in this example) between the cone and the wafer back side are compressed in order to form a fluid-tight seal that provides wafer back side protection. In this third position, the wafer front side and the electrical contacts embedded in the elastomeric lip seal of the cup are rinsed.

To reiterate, the embodiment of FIGS. 2A–2E has certain features that facilitate rinsing/cleaning. First, the embodiment holds the wafer on the cone so that in situ rinsing does not contaminate the surface of the cone and thereby become a source for backside contamination of the wafer. It is believed the cone contamination can occur as rinsate washes crystals from the lip and splatters onto the cone. Second, the cup and cone partially separate to an intermediate rinse position (shown in FIG. 2E). This causes rinse spray from the plating cell to be focused to a narrow opening adjacent to the contacts. If the cup and cone are fully separated to the wafer load/unload position, the rinse spray is diffuse and its effectiveness is reduced.

Water (or other fluid) may be used to rinse the apparatus in various ways. Three of these follow: (1) a rinse nozzle, attached to the plating cell, can rinse the closed clamshell, (2) the wafer (which is attached to the cone via the wafer vacuum clamp while the clamshell is partially open) is sprayed with water across the its surface and onto the contact and seal area, and (3) water is flushed through a third channel while the clamshell is partially open (at which point the wafer is preferably, but not necessarily, present). In the third embodiment, the cleaning fluid may be dispersed via channels internal to the mechanism for temporarily attaching the work piece to the cone's work piece contact surface. For example, water may be provided through a port in the cone, such as a port in region 225. The swage lock fitting 283 depicted in FIG. 2C is intended to provide a conduit of cleaning fluid for this purpose. In all of the above cases, rotation can be used to provide the agitation needed to adequately rinse the surfaces. Rotation may also be used to dry the wafer and clamshell.

Although various details have been omitted for clarity's sake, various design alternatives may be implemented. Therefore, the present examples are to be considered as illustrative and not restrictive, and the invention is not to be limited to the details given herein, but may be modified within the scope of the appended claims.

What is claimed is:

1. An apparatus for engaging a work piece during a plating process, the apparatus comprising:

a cup having an interior region and a lip within the interior region arranged such that the lip can support the work piece while the work piece remains within the interior region;

a cone having a work piece contact surface that fits within the cup's interior and can contact the work piece in a manner that holds the work piece in a fixed position between the work piece contact surface and the lip; and a spray skirt extending around an outer circumference of the cone and around an interface between the cup and the cone when cup and cone engage each other to hold the work piece, wherein the spray skirt protects features on the cup from exposure to a plating solution during the plating process.

2. The apparatus of claim 1, wherein the spray skirt is attached to the cone.

3. The apparatus of claim 1, wherein in the spray skirt is made from a material selected from the group consisting of PVDF, PPS, PTFE, polypropylene, PVC, polyethylene, and stainless steel.

4. The apparatus of claim 1, wherein the spray skirt comprises a vertical cylindrical structure.

5. The apparatus of claim 4, wherein the spray skirt further comprises a flat circular plate engaging a top region of the cylindrical structure.

6. The apparatus of claim 1, further comprising a cup-contacting surface attached to the spray skirt to block penetration of the plating solution to the interface between the cup and the cone during plating.

7. The apparatus of claim 1, wherein the cone comprises a circumferential shielding lip extending about its lower surface and engaging a complementary surface on the cup to thereby block penetration of the plating solution to the interface between the cup and the cone during plating.

8. The apparatus of claim 7, wherein the complementary surface of the cup comprises an elastomeric seal.

9. The apparatus of claim 7, wherein the elastomeric seal is made from a fluoropolymer.

10. The apparatus of claim 1, further comprising one or more vacuum seals for facilitating engagement of the cup and cone while holding the work piece.

11. The apparatus of claim 1, wherein the plating solution comprises an acidic solution of copper ions.

12. The apparatus of claim 11, wherein the lip comprises a lip seal made from a material that provides a fluid-tight seal with the work piece when the work piece is held in place by the cone.

13. The apparatus of claim 12, wherein the width of the lip seal is between about 0.25 and 4 mm wide.

14. The apparatus of claim 12, wherein the material is an elastomer comprising at least one of a silicone rubber, a fluoropolymer, a butyl rubber.

15. The apparatus of claim 1, wherein the work piece is a semiconductor wafer.

16. The apparatus of claim 1, wherein at least a portion of the cup comprises at least one of a plastic, a ceramic, a plastic-coated ceramic, a plastic-coated metal, a glass, a glass-coated metal, a glass-coated ceramic, a silicon-oxide coated ceramic, and a composite.

17. The apparatus of claim 1, wherein the apparatus is for plating a copper seed layer or copper bulk fill layer.

18. An apparatus for engaging a work piece during a plating process, the apparatus comprising:

a cup having an interior region and a lip within the interior region arranged such that the lip can support the work piece while the work piece remains within the interior region;

a cone having a work piece contact surface that fits within the cup's interior and can contact the work piece in a manner that holds the work piece in a fixed position between the work piece contact surface and the lip, the cone being movable toward and away from the cup;

a mechanism for temporarily attaching the work piece to the cone's work piece contact surface, whereby the work piece, together with the cone, can be separated from the cup; and a cleaning fluid delivery system for delivering a cleaning fluid to at least one of the cup, cone, and work piece while the work piece is attached to the cone's work piece contact surface.

19. The apparatus of claim 18, wherein the mechanism for temporarily attaching the work piece to the cone's work piece contact surface is a vacuum engagement device.

20. The apparatus of claim 19, further comprising a remote control valve or a poppet valve in the cone, which poppet valve activates when the cone contacts the work piece.

21. The apparatus of claim 18, wherein the cleaning fluid delivery device comprises a spray nozzle.

22. The apparatus of claim 21, wherein the spray nozzle is disposed in a plating chamber that houses the cup and cone.

23. The apparatus of claim 21, wherein the cleaning fluid is dispersed via channels internal to the mechanism for temporarily attaching the work piece to the cone's work piece contact surface.

24. The apparatus of claim 18, wherein the cleaning fluid is water.

25. The apparatus of claim 18, wherein the cone comprises a circumferential shielding lip extending about its lower surface and engaging a complementary surface on the cup to thereby block penetration of a plating solution to the interface between the cup and the cone during plating.

26. The apparatus of claim 25, wherein the complementary surface of the cup comprises an elastomeric seal.

27. The apparatus of claim 25, wherein the elastomeric seal is made from a silicone rubber or fluoropolymer.

28. The apparatus of claim 18, further comprising one or more vacuum seals for facilitating engagement of the cup and cone while holding the work piece.

29. The apparatus of claim 18, wherein the plating chamber is designed to hold a plating solution comprising an acidic solution of copper ions.

30. The apparatus of claim 18, wherein the work piece is a semiconductor wafer.

31. The apparatus of claim 18, wherein the lip comprises a lip seal made from a material that provides a fluid-tight seal with the work piece when the work piece is held in place by the cone.

* * * * *